US010286233B2

(12) United States Patent
Wang et al.

(10) Patent No.: US 10,286,233 B2
(45) Date of Patent: May 14, 2019

(54) ERGONOMIC BACK PLATE FOR SELF-CONTAINED BREATHING APPARATUS

(75) Inventors: Leo Wang, Shanghai (CN); Yajun-Edwin Zhang, Shanghai (CN); Jimmy Zheng, Shanghai (CN); Pete Madson, Shanghai (CN); Shelly Chen, Shanghai (CN)

(73) Assignee: Honeywell International Inc., Morris Plains, NJ (US)

( * ) Notice: Subject to any disclaimer, the term of this patent is extended or adjusted under 35 U.S.C. 154(b) by 580 days.

(21) Appl. No.: 14/371,077

(22) PCT Filed: Jan. 18, 2012

(86) PCT No.: PCT/US2012/021655

§ 371 (c)(1),
(2), (4) Date: Jul. 8, 2014

(87) PCT Pub. No.: WO2013/109260

PCT Pub. Date: Jul. 25, 2013

(65) Prior Publication Data

US 2014/0345604 A1 Nov. 27, 2014

(51) Int. Cl.
*A62B 9/04* (2006.01)
*A62B 7/02* (2006.01)
(Continued)

(52) U.S. Cl.
CPC ..... *A62B 9/04* (2013.01); *A45F 3/08* (2013.01); *A62B 7/02* (2013.01); *A45F 2003/045* (2013.01)

(58) Field of Classification Search
CPC ..... A45F 3/02; A45F 3/08; A45F 3/10; A45F 3/12; A45F 3/122; A45F 3/125;
(Continued)

(56) References Cited

U.S. PATENT DOCUMENTS 4,327,851 A 5/1982 Feathers
5,564,612 A 10/1996 Gregory
(Continued)

FOREIGN PATENT DOCUMENTS

CN 1697617 A 11/2005
CN 201248937 Y 6/2009
(Continued)

OTHER PUBLICATIONS

China Patent Application No. 201280067321.1, Office Action, dated Dec. 21, 2015, 17 pages.
(Continued)

*Primary Examiner* — Tan-Uyen T Ho
*Assistant Examiner* — Elliot S Ruddie
(74) *Attorney, Agent, or Firm* — Wick Phillips Gould & Martin LLP

(57) ABSTRACT

A self-contained breathing apparatus. The self-contained breathing apparatus comprises a back plate comprising a shoulder strap load portion and a waist belt load portion, wherein the waist belt load portion rotates about an extended axis defined by the junction of the waist belt load portion with the shoulder strap load portion, a shoulder strap coupled to the shoulder strap load portion of the back plate, a waist belt coupled to the waist belt load portion of the back plate, and a bottle of compressed breathable air secured to the shoulder strap load portion of the back plate.

16 Claims, 8 Drawing Sheets

(51) Int. Cl.
*A45F 3/08* (2006.01)
*A45F 3/04* (2006.01)

(58) Field of Classification Search
CPC ..... A45F 3/127; A45F 2003/045; A62B 7/02; A62B 9/04; A62B 25/00; F17C 2270/025; F17C 2270/0545; F17C 2270/0754; F17C 2270/0781; F17C 2270/079; B63C 11/00
USPC ..... 2/1, 69, 94; 24/3.1; 128/205.22, 201.22, 128/201.29, 202.19, 202.13; 182/3; 224/158, 905, 907, 934, 101, 148.1, 224/148.7, 262; 405/186, 187, 455, 456, 405/92, 102, 915
See application file for complete search history.

(56) References Cited

U.S. PATENT DOCUMENTS

| | | | | |
|---|---|---|---|---|
| 5,954,250 | A * | 9/1999 | Hall | A45F 3/047 224/262 |
| 7,726,312 | B2 | 1/2010 | Chapman et al. | |
| 8,006,877 | B2 * | 8/2011 | Lowry | A45F 3/04 224/262 |
| 2003/0140392 | A1 | 7/2003 | Kling et al. | |
| 2007/0090137 | A1 * | 4/2007 | Kim | A45F 3/047 224/153 |
| 2009/0321481 | A1 | 12/2009 | Licausi | |
| 2011/0197891 | A1 | 8/2011 | Sanders | |

FOREIGN PATENT DOCUMENTS

| | | | |
|---|---|---|---|
| CN | 101686749 | A | 3/2010 |
| CN | 101879360 | A | 11/2010 |
| CN | 104039397 | A | 9/2014 |
| EP | 0747095 | A2 | 12/1996 |
| EP | 2804673 | | 11/2014 |
| WO | 2013109260 | A1 | 7/2013 |

OTHER PUBLICATIONS

China Patent Application No. 201280067321.1, Office Action, dated Sep. 5, 2016, 10 pages.
China Patent Application No. 201280067321.1, Decision on Rejection, dated Mar. 9, 2017,8 pages.
Europe Patent Application No. 12 866 290.5, Examination Report, dated Apr. 19, 2017, 7 pages.
ACSi SCBA, Product brochure, https://www.scottsafety.com/en/us/DocumentandMedia1/Marketing/ ProductLiteratureandCatalogs/Brochures/Bro-ACSi-HS-6887-0111.pdf, Nov. 11, 2011, 4 pages.
ACSi Scba, Product brochure, https://www.scottsafety.com/en/us/DocumentandMedia1/Marketing/ ProductLiteratureandCatalogs/Brochures/Bro-ACSi-HS-6887A-0411.pdf, Nov. 11, 2011, 4 pages.
Extended European Search Report, EP Application No. 12 866 2905, dated Aug. 24, 2015, 9 pages.
China Patent Application No. 201280067321.2, Office Action, dated Dec. 21, 2015, 17 pages.
China Patent Application No. 201280067321.2 Office Action, dated Sep. 5, 2016, 10 pages.
International Patent Application No. PCT/US2012/021655, International Preliminary Report on Patentability, dated Jul. 22, 2014, 6 pages.
International Patent Application No. PCT/US2012/021655, International Search Report and Written Opinion of the International Searching Authority, dated Sep. 27, 2012, 8 pages.
Europe Application No. 12 866 290.5, Communication pursuant to Article 94(3) EPC dated Dec. 15, 2017, 6 pages.
China Patent Application No. 201280067321.2, Reexamination Notice, dated Mar. 3, 2017, 17 pages.
China Patent Application No. 201280067321.2, Decision on Rejection, dated Mar. 9, 2017, 8 pages.
China Patent Application No. 201280067321.2, Reexamination Notice, dated Jul. 19, 2018, 21 pages.
China Patent Application No. 201280067321.2, Decision of Reexamination, dated Feb. 12, 2019, 39 pages.

* cited by examiner

ERGONOMIC BACK PLATE FOR SELF-CONTAINED BREATHING APPARATUS

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Self-contained breathing apparatuses typically comprise a store of compressed breathable air that is worn by firefighters, rescue workers, and others to provide breathable air. The user breathes air supplied from the store of compressed breathable air while performing work. In the case of firefighters, for example, the work may be strenuous and involve a variety of bending and stretching motions. For example, a firefighter may bend over forwards to pick up items. A firefighter may bend over forwards to lower himself to pass through a hole. Likewise, a firefighter may lean sideways to clear an obstruction or to pick up items. Firefighters may wear a utility belt or fire belt that is used to carry tools such as a hammer, one or more wrenches, a flashlight, and/or other tools.

SUMMARY

In an embodiment, a self-contained breathing apparatus is disclosed. The self-contained breathing apparatus comprises a back plate comprising a shoulder strap load portion and a waist belt load portion, wherein the waist belt load portion rotates about an extended axis defined by the junction of the waist belt load portion with the shoulder strap load portion, a shoulder strap coupled to the shoulder strap load portion of the back plate, a waist belt coupled to the waist belt load portion of the back plate, and a bottle of compressed breathable air secured to the shoulder strap load portion of the back plate.

In an embodiment, a self-contained breathing apparatus is disclosed. The self-contained breathing apparatus comprises a back plate comprising a shoulder strap load portion and a waist belt load portion, wherein the waist belt load portion rotates about an extended axis defined by the junction of the waist belt load portion with the shoulder strap load portion and wherein the waist belt load portion comprises a hole on a centered vertical axis of the waist belt load portion, a first curved slot on a left side of the centered vertical axis of the waist belt load portion, and a second curved slot on a right side of the centered vertical axis of the waist belt load portion. The self-contained breathing apparatus further comprises a shoulder strap coupled to the shoulder strap load portion of the back plate. The self-contained breathing apparatus further comprises a waist belt, wherein the waist belt is coupled to the waist belt load portion of the back plate with a first pin mated to the first curved slot, with a second pin mated to the second curved slot, and with a third pin mated to the hole on the centered vertical axis of the waist belt load portion of the back plate, wherein the waist belt load portion of the back plate rotates about an axis defined by the hole with respect to the waist belt and wherein the first pin slides in the first curved slot and the second pin slides in the second curved slot to enable rotation of the waist belt load portion with respect to the waist. The self-contained breathing apparatus further comprises a bottle of compressed breathable air secured to the shoulder strap load portion of the back plate.

In an embodiment, a self-contained breathing apparatus back plate is disclosed. The self-contained breathing apparatus back plate comprises a shoulder strap load back plate portion and a waist belt load back plate portion, wherein the waist belt load portion rotates about an extended axis defined by the junction of the waist belt load portion with the shoulder strap load portion.

These and other features will be more clearly understood from the following detailed description taken in conjunction with the accompanying drawings and claims.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

Figure 1:
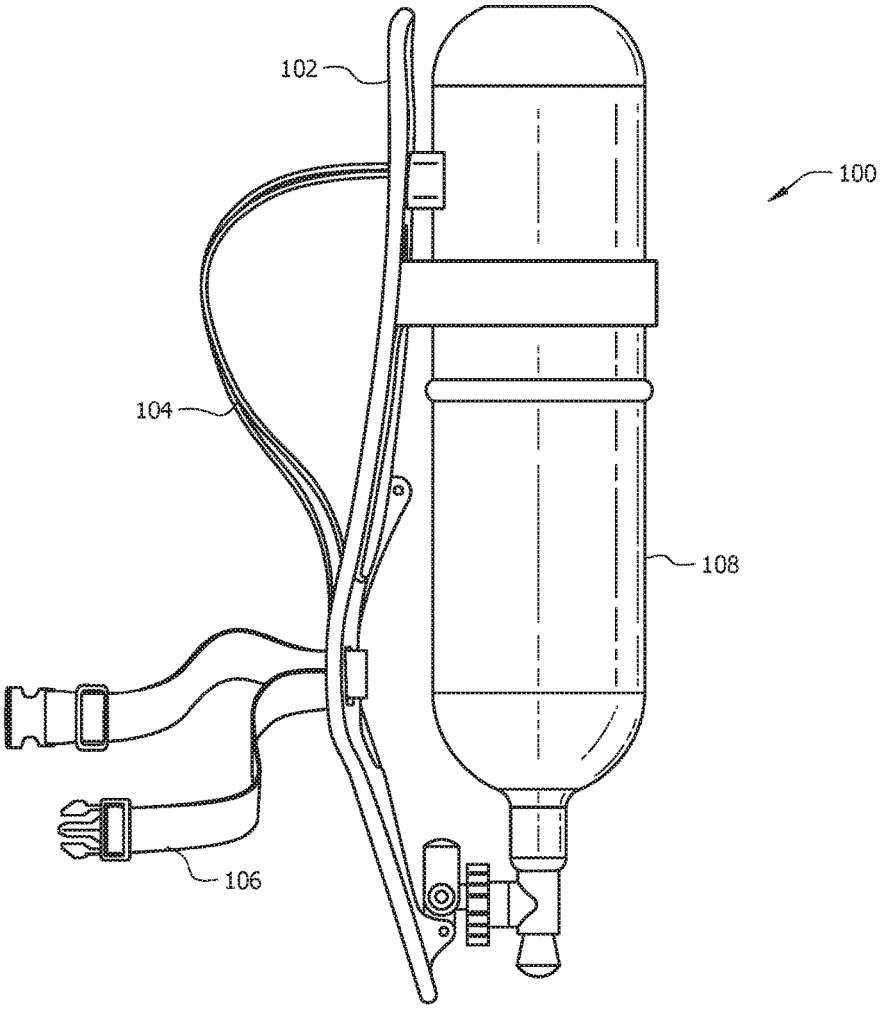
FIG. 1 is an illustration of a self-contained breathing apparatus according to an embodiment of the disclosure.

FIG. 1 illustrates a self-contained breathing apparatus 100. In an embodiment, the self-contained breathing apparatus 100 comprises a back plate 102, two shoulder straps 104, a waist belt 106, and a store of breathable air 108. It is understood that the self-contained breathing apparatus 100 may comprise other elements that are omitted from FIG. 1 such as a breathing hose, a breathing regulator, a padded cover or padding structure to make the fit of the back plate 102 to a user of the self-contained breathing apparatus 100 more comfortable, as well as other features. In an embodiment, the back plate 102 provides a load bearing structure to transfer the weight of the store of breathable air 108 to the body of the user of the self-contained breathing apparatus 100 via the shoulder straps 104 and via the waist belt 106. In an embodiment, the back plate 102 is configured to reduce accidental catching of the self-contained breathing apparatus 100 on obstructions or other structures as the user moves in the performance of his work, for example to reduce catching of the self-contained breathing apparatus 100 on a desk in a burning commercial office building. In an embodiment, the back plate 102 is configured to promote the user maintaining a safe posture and to protect at least partially the user from injury, for example from over extending in a direction that may injure the back of the user. In an embodiment, the back plate 102 is configured to provide increased comfort to the user, for example by yielding appropriately to the user bending over or leaning sideways and by reducing interference with a tool belt customarily worn in the performance of a job. It is thought that the back plate 102 of the present disclosure provides improved ergonomics.

Figure 2A:
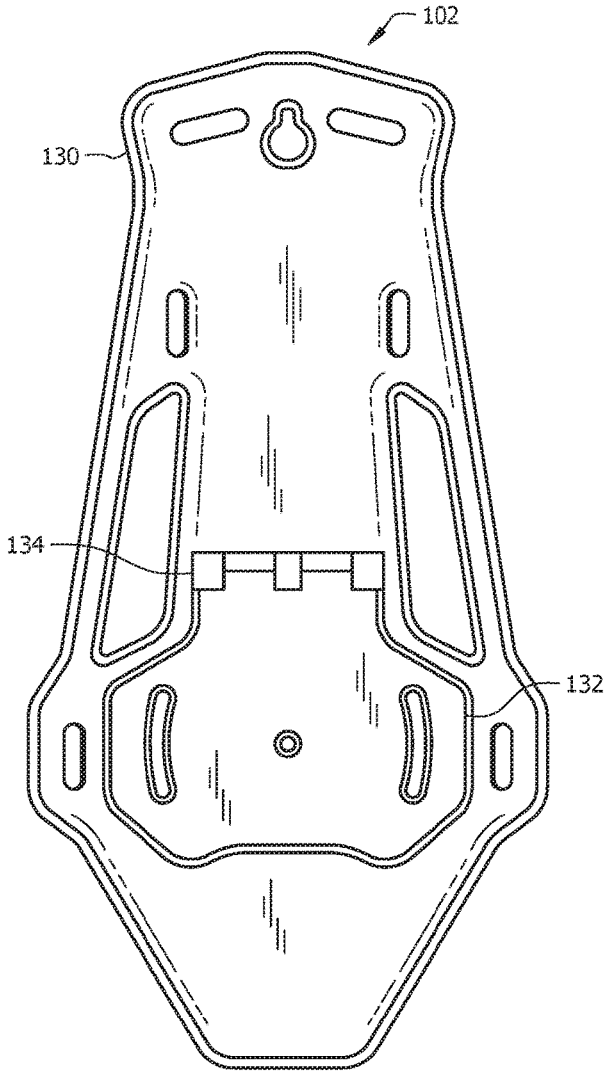
FIG. 2A is an illustration of a front view of a back plate for use in a self-contained breathing apparatus according to an embodiment of the disclosure.
Figure 2B:
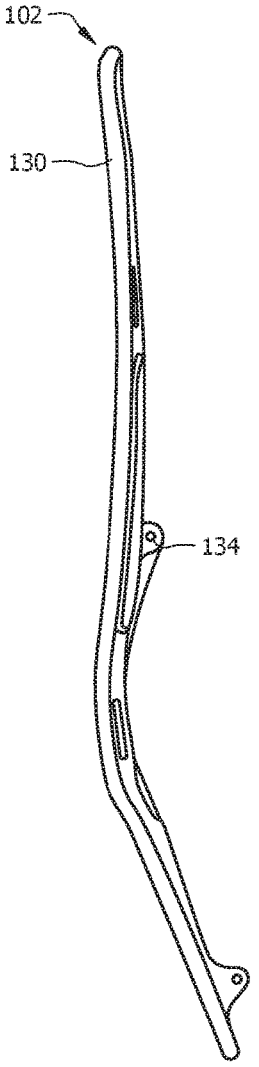
FIG. 2B is an illustration of a side view of a back plate for use in a self-contained breathing apparatus according to an embodiment of the disclosure, with the waist belt load portion in an unpivoted position with respect to the shoulder strap load portion of the back plate.
Figure 2C:
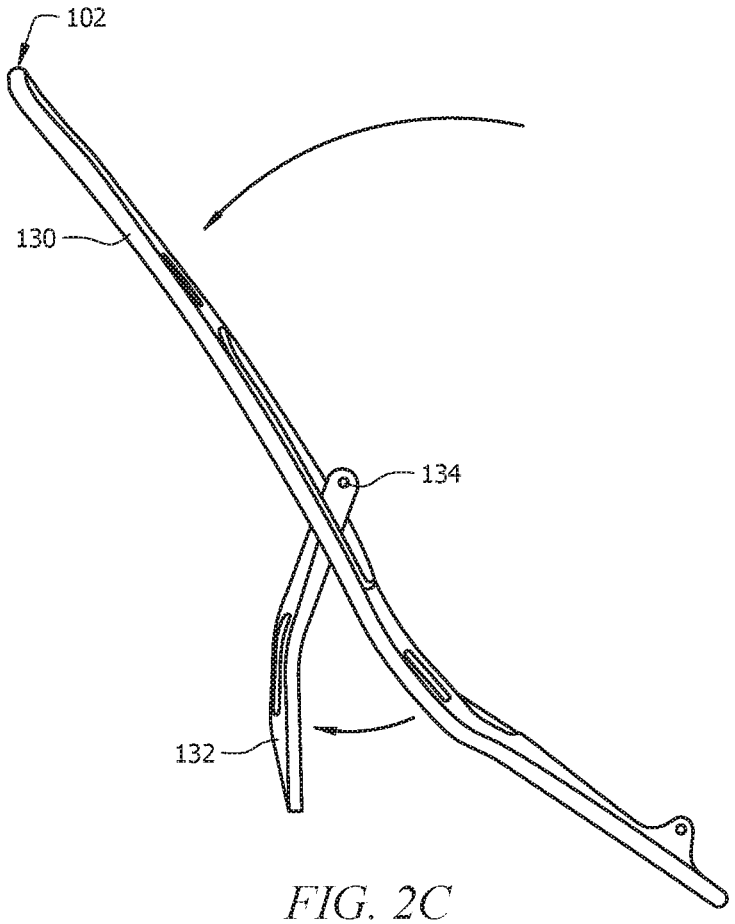
FIG. 2C is an illustration of a view of a back plate depicting rotation (e.g. an exemplary pivoted position) a waist belt load portion of the back plate with respect to a shoulder strap load portion of the back plate for use in a self-contained breathing apparatus according to an embodiment of the disclosure.
Figure 2D:
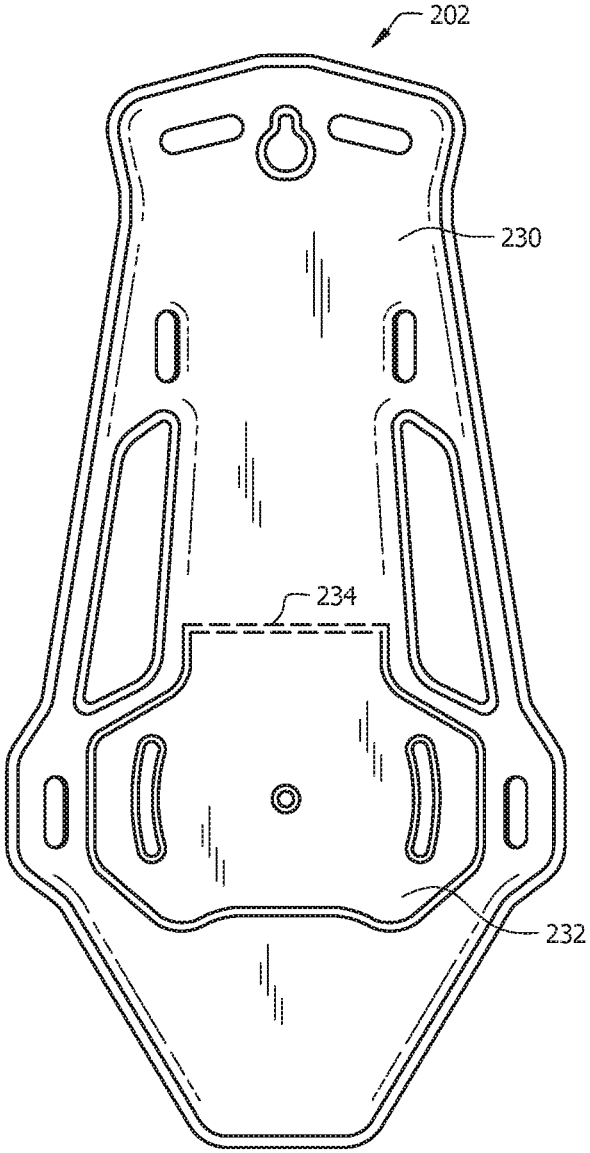
FIG. 2D is an illustration of a front view of a back plate according to another embodiment of the disclosure.

Turning now to FIG. 2A, FIG. 2B, and FIG. 2C, details of the back plate 102 are described. In an embodiment, the back plate 102 comprises a shoulder strap load portion 130 and a waist belt load portion 132. The shoulder strap load portion 130 is so named because it transfers at least some of the load of the store of breathable air 108 to the shoulder straps 104. The waist belt load portion 132 is so named because it transfers at least some of the load of the store of breathable air 108 to the waist belt 106. In an embodiment, the store of breathable air 108 is secured to the shoulder strap load portion 130. The shoulder strap load portion 130 may be shaped to reduce catching of the back plate 102 on obstructions as the user performs his work. For example, the shoulder strap load portion 130 may be tapered at a lower end and at an upper end to reduce the chances of the back plate 102 catching on obstructions. The shoulder strap load portion 130 may be provided with apertures to reduce the weight of the back plate 102 and to promote the circulation of air to promote the comfort of the user. As best seen in FIG. 2B, the lower end of the back plate 102 may be shaped to curve away from the small of the back of a user to provide clearance for walking motions of the user and clearance for a tool belt and/or fire belt.

The shoulder strap load portion 130 and the waist belt load portion 132 may be made of a variety of materials. In an embodiment, the shoulder strap load portion 130 and the waist belt load portion 132 may comprise thermoplastic material, for example acrylonitrile butadiene styrene (ABS) or other thermoplastic. In an embodiment, the shoulder strap load portion 130 and the waist belt load portion 132 may comprise ABS in combination with nylon. In an embodiment, the shoulder strap load portion 130 and the waist belt load portion 132 may comprise ABS in combination with nylon and Kevlar. In another embodiment, however, the shoulder strap load portion 130 and the waist belt load portion 132 may be made of other materials.

While the material of the shoulder strap load portion 130 and the waist belt load portion 132 may flex somewhat in response to user motion, generally the shoulder strap load portion 130 and the waist belt load portion 132 will retain their original shape, and user motion will be accommodated by the rotation of the waist belt load portion 132 with respect to the shoulder strap load portion 130 along an extended axis defined by the junction 134 of the waist belt load portion 132 with the shoulder strap load portion 130. This motion is best seen in FIGS. 2B-2C, showing both the unpivoted and pivoted positions/configurations. While in the unpivoted position shown in FIG. 2B, the waist belt load portion typically does not extend beyond a front side of the shoulder strap load portion, but for example may be substantially flush with the front side while fitting substantially entirely within an aperture in the shoulder strap load portion. In some contexts, the shoulder strap load portion 130 may be characterized as semi-rigid, and the waist belt load portion 132 may be characterized as semi-rigid.

In an embodiment, the shoulder strap load portion 130 and the waist belt load portion 132 are coupled to each other by a junction 134. In an embodiment, the junction 134 may be substantially orthogonal/perpendicular to a vertical axis of the back plate 102 (e.g. a longitudinal centerline of the shoulder strap load portion). In an embodiment, the junction 134 may be provided by a hinge. In another embodiment, back plate 102 may comprise a single piece of material, and the junction 134 may comprise a line where the material is thinner in cross section than the adjacent area of the shoulder strap load portion 130 and thinner in cross section than the adjacent area of the waist band load portion 132. Thus, this area of thinner cross section is an area of greater flexibility or greater weakness and defines an extended axis about which the waist belt load portion 132 can rotate with respect to the shoulder strap load portion 130.

Figure 3A:
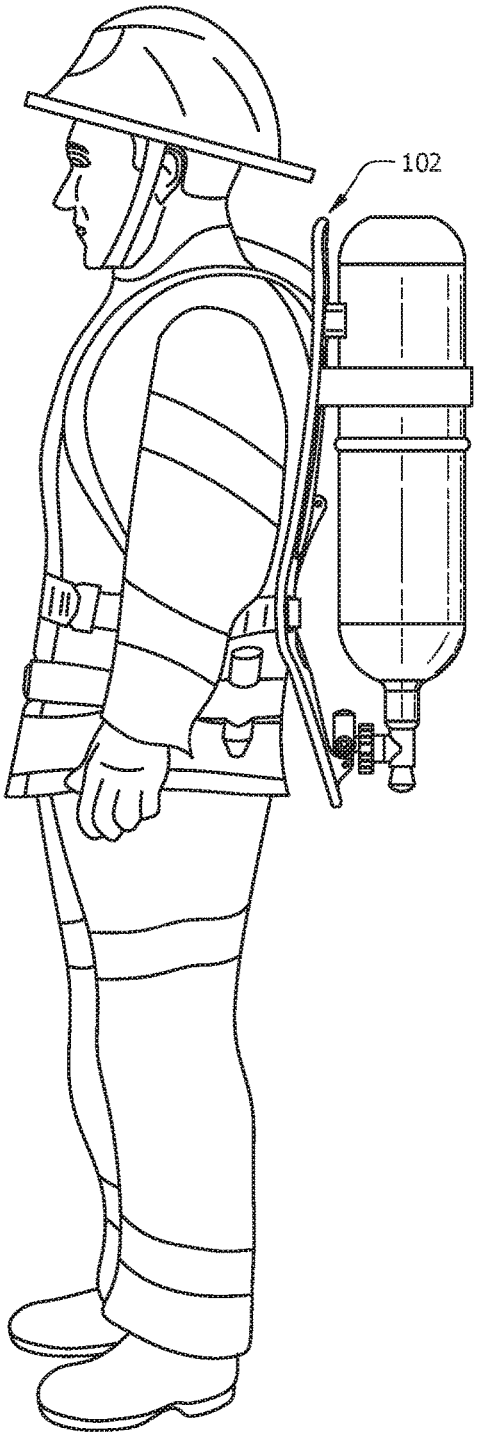
FIG. 3A is an illustration of a firefighter standing in an upright position while wearing a self-contained breathing apparatus according to an embodiment of the disclosure.
Figure 3B:
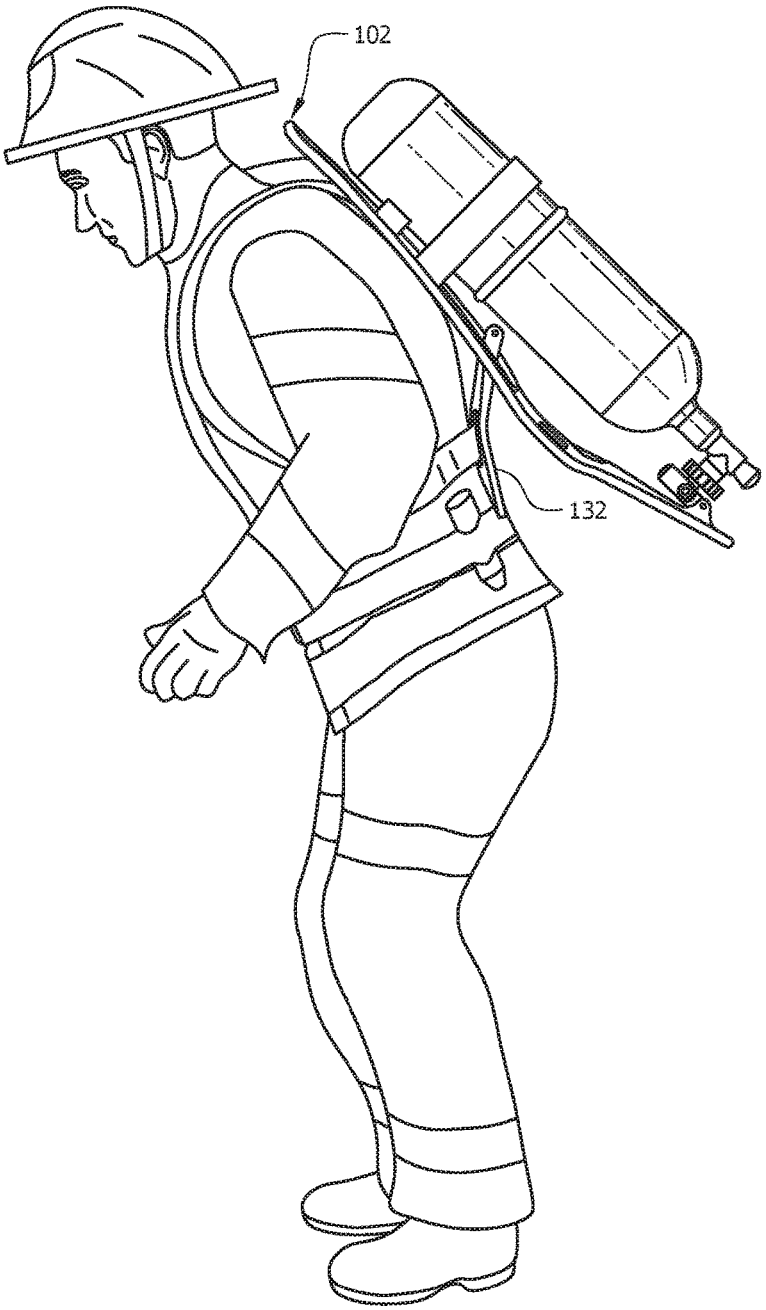
FIG. 3B is an illustration of a firefighter standing in a partially bent-over position while wearing a self-contained breathing apparatus according to an embodiment of the disclosure.

Turning now to FIG. 3A and FIG. 3B, a firefighter is illustrated wearing the back plate 102. When bending over, as illustrated in FIG. 3B, the waist belt load portion 132 rotates along the junction 134 with reference to the shoulder strap load portion 130. It can be appreciated that the back plate 102 promotes increased freedom of motion at the same time that it securely supports the weight of the store of breathable air 108 and promotes a safe posture of the user.

Figure 4:
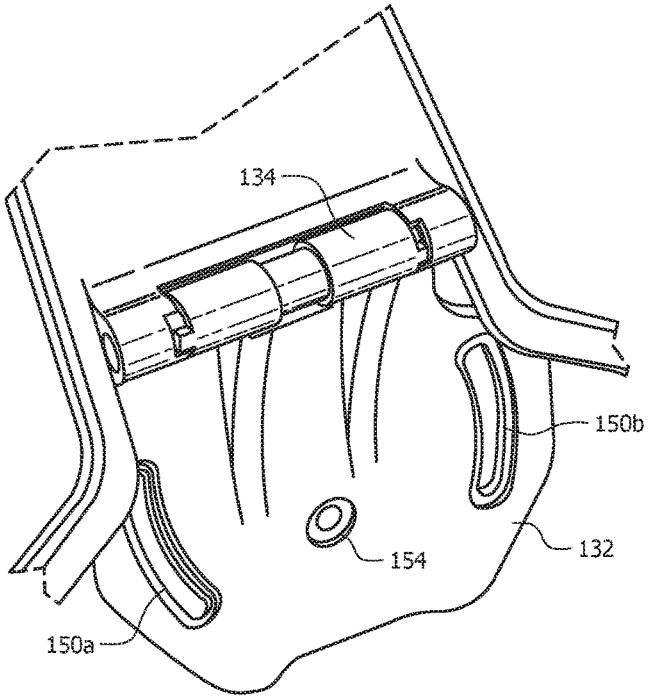
FIG. 4 is an illustration of a hinge element of a back plate for use in a self-contained breathing apparatus according to an embodiment of the disclosure.

Turning now to FIG. 4, further details of an embodiment of the junction 134 and of the waist belt load portion 132 are described. In an embodiment, the junction 134 is provided by a hinge. In an embodiment, the hinge may be biased to a position in which the waist belt load portion 132 is aligned with the shoulder strap load portion 130, as best seen in FIG. 2B. The biasing may be provided by a spring or other mechanism. In an embodiment, the hinge may incorporate stops that arrest rotation about an axis of the hinge. For example, a first stop may arrest rotation of the waist belt load portion 132 with respect to the shoulder strap load portion 130 at a limit of clockwise rotation and a second stop may arrest rotation of the waist belt load portion 132 with respect to the shoulder strap load portion 130 at a limit of counterclockwise rotation. It is understood that a variety of stop structures are contemplated for use in limiting the range of rotation of the waist belt load portion 132 with respect to the shoulder strap load portion 130. In an embodiment, a stop may be provided by a tab projecting from one portion of a hinge that is free to travel over a limited range by a slot or cut-out in a second portion of the hinge, as seen in FIG. 4. By adapting the slot or cut-out length and positions of the ends of the slot and the position of the tab, a range of rotation may be provided. The projecting tab and slot may be located at one place in the hinge structure or at a plurality of places in the hinge structure to distribute the stress of stopping among a plurality of stopping structures.

In another embodiment, a stop may be provided by a projecting lip on the outside of the hinge such that as the waist belt load portion 132 rotates with respect to the shoulder strap load portion 130, a projecting lip on the outside of the hinge portion integral with the waist belt load portion 132 is stopped by the shoulder strap load portion 130 and a projecting lip on the outside of the hinge portion integral with the shoulder strap load portion 130 is stopped by the waist belt load portion 132. It is contemplated that any number of projecting lips may be employed to provide the stops, a single projecting lip or a plurality of projecting lips. A plurality of projecting lips may promote distribution of the stress of stopping among the plurality of projecting lips.

The stops may be configured to restrict the rotation of the waist belt load portion 132 with respect to the shoulder strap load portion 130 to a predetermined range of rotation. For example, the stops may restrict rotation to less than 90 degrees of rotation, to less than 45 degrees of rotation, to less than 30 degrees of rotation, or to some other range of rotation. Additionally, the stops may be configured to stop the rotation of the waist belt load portion 132 with respect to the shoulder strap load portion 130 at a particular location to promote safe postures of the user of the self-contained breathing apparatus 100, for example to avoid over bending of the back of the user. In an embodiment, the stops may be configured to stop the waist belt load portion 132 at a position aligned with the shoulder strap load portion 130, as best seen in FIG. 2B, and to stop the waist belt load portion 132 at a position rotated about 45 degrees with respect to the shoulder strap load portion 130, as best seen in FIG. 2C.

Figure 5:
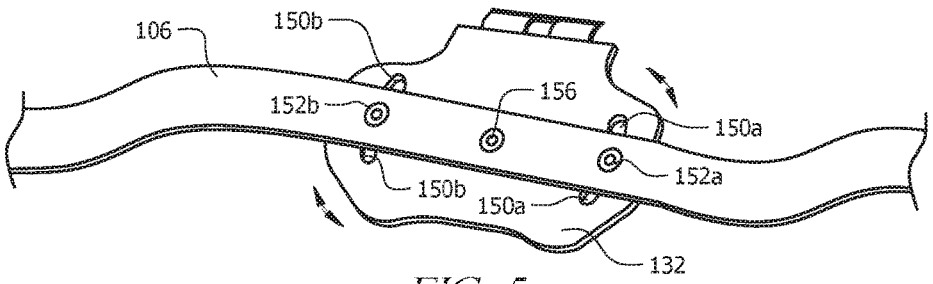
FIG. 5 is an illustration of a waist belt coupled to a waist belt load portion of a back frame for use in a self-contained breathing apparatus according to an embodiment of the disclosure.

In an embodiment, the waist belt load portion 132 comprises one or more of a first curved slot 150*a* and a second curved slot 150*b* and a hole 154 for coupling to the waist belt 106. The curved slots 150*a* and *b* provide for rotation of the waist belt bearing portion 132 with respect to the waist belt 106, as best seen in FIG. 5, while the hole 154 provides for transferring at least part of the load of the store of breathable air 108 to the waist belt 106. It is understood that the curved slots 150*a* and *b* and the hole 154 are contemplated to take a variety of different forms. The hole 154 may be located substantially on a central vertical axis of the back plate 102. As illustrated in FIG. 4, the curved slots 150*a* and *b* may be shouldered or have an interior lip or race.

Figure 6:
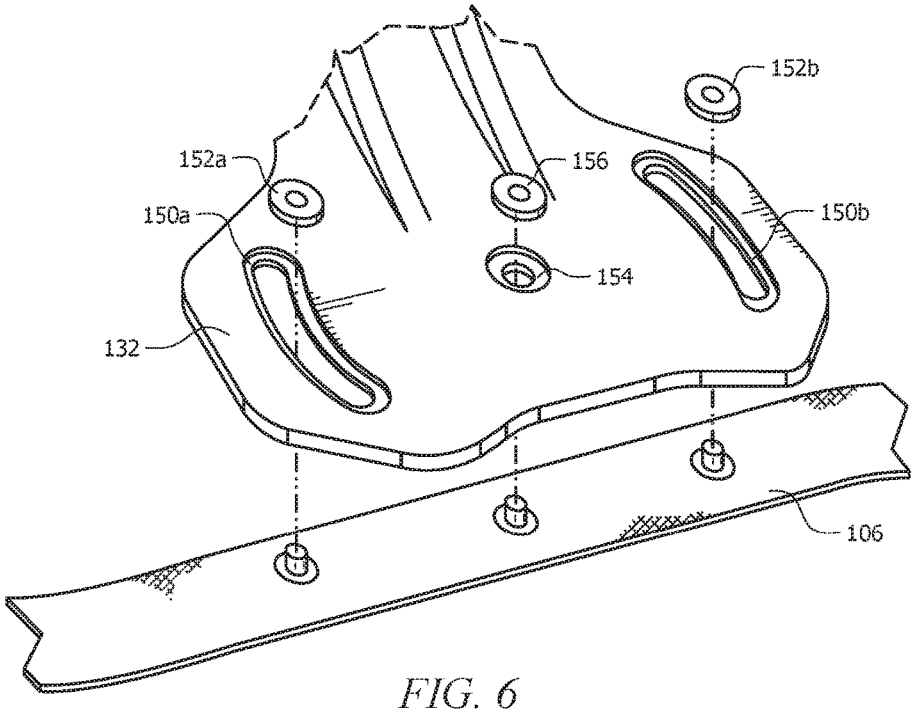
FIG. 6 is an illustration of a mechanism for coupling a waist belt to a waist belt load portion of a back frame for use in a self-contained breathing apparatus according to an embodiment of the disclosure.

Turning now to FIG. 6, further details of an embodiment of a mechanism for coupling the waist belt 106 to the waist belt load portion 132 are described. A first pin 152*a* and retaining disk may pass through the first curved slot 150*a*, a second pin 152*b* and retaining disk may pass through the second curved slot 150*b*, and a third pin 156 and retaining disk may pass through the hole 154. The disks may be rivets, screw heads, bolt heads or other known attachment devices. The disks of the pins 152*a* and *b* may ride in the shoulder of the curved slots 150*a* and *b* and secure the waist belt 106 to the waist belt load portion 132 in a manner such that the pins 152*a* and *b* can slide in the curved slots 150*a* and *b*, permitting the waist belt load portion 132 to rotate around an axis defined by the third pin 156 with respect to the waist belt 106. In an embodiment, a portion of the load of the store of breathable air 108 is transferred from the waist belt load portion 132 via the third pin 156 to the waist belt 106. In the instance that the third pin 156 may be broken, as for example after extended use of the self-contained breathing apparatus 100, possibly in harsh and/or abusive use conditions as may sometimes occur in emergency situations, the pins 152*a* and *b* may cooperate to bear the load transferred from the waist belt load portion 132 to the waist belt 106 until such time as the damaged self-contained breathing apparatus 100 may be replaced and/or repaired. The pins 152*a* and *b* may further contribute to maintaining safe posture of the user of the self-contained breathing apparatus 100.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A self-contained breathing apparatus, comprising:

a back plate comprising a shoulder strap load portion with a longitudinal centerline and a waist belt load portion pivotally coupled to the shoulder strap load portion with a hinge disposed a rear side of the shoulder strap load portion, wherein the waist belt load portion has an upper end connected to the hinge and a lower end distal the hinge, wherein the waist belt load portion is configured to extends through an aperture in the shoulder strap load portion and is configured so that, when in an unpivoted position, the waist belt load portion is substantially flush with a front side of the shoulder strap load portion, wherein the waist belt load portion is configured to rotate about an axis of rotation of the hinge oriented perpendicular to the longitudinal centerline of the shoulder strap load portion, and wherein the waist belt load portion comprises a hole on a centered vertical axis of the waist belt load portion, a first curved slot on a left side of the centered vertical axis of the waist belt load portion, and a second curved slot on a right side of the centered vertical axis of the waist belt load portion;

a shoulder strap coupled to the shoulder strap load portion of the back plate;

a waist belt, wherein the waist belt is coupled to the waist belt load portion of the back plate with a first pin mated to the first curved slot, with a second pin mated to the second curved slot, and with a third pin mated to the hole on the centered vertical axis of the waist belt load portion of the back plate, wherein the waist belt load portion of the back plate is configured to rotate about an axis defined by the hole with respect to the waist belt and wherein the first pin slides in the first curved slot and the second pin slides in the second curved slot to enable rotation of the waist belt load portion with respect to the waist belt; and a bottle of compressed breathable air disposed along the rear side of the shoulder strap load portion and secured to the shoulder strap load portion of the back plate;

wherein a lower end of the back plate is shaped to curve away from a user's back when wearing the apparatus.

2. The self-contained breathing apparatus of claim 1, wherein the hinge comprises stops that arrest rotation of the waist belt load portion of the back plate relative to the shoulder strap load portion of the back plate at ends of a range of rotation.

3. The self-contained breathing apparatus of claim 1, wherein the hinge comprises a spring to bias the waist belt load portion of the back plate to a position aligned with the shoulder strap load portion of the back plate.

4. The self-contain d breathing apparatus of claim 1, wherein the shoulder strap load portion of the back plate and the waist belt load portion of the back plate comprises thermoplastic.

5. A self-contained breathing apparatus, comprising:

a back plate comprising a shoulder strap load portion with a longitudinal centerline and a waist belt load portion pivotally coupled to the shoulder strap load portion with a hinge attached to a rear side of the shoulder strap load portion, wherein the waist belt load portion has an upper end connected to the hinge and a lower end distal the hinge, wherein the waist belt load portion is configured to fit substantially entirely within an aperture in the shoulder strap load portion and is configured so that, when in an unpivoted position, the waist belt load portion does not extend beyond a front side of the shoulder strap load portion, wherein the waist belt load portion is configured to rotate about an axis of rotation of the hinge oriented perpendicular to the longitudinal centerline of the shoulder strap load portion;

a shoulder strap coupled to the shoulder strap load portion of the back plate;

a waist belt coupled to the waist belt load portion of the back plate; and a bottle of compressed breathable air secured to the shoulder strap load portion of the back plate;

wherein a lower end of the back plate is shaped to curve away from a user's back when wearing the apparatus.

6. The self-contained breathing apparatus of claim 5, wherein the waist belt load portion of the back plate comprises a hole on a centered vertical axis of the waist belt load portion, a first curved slot on a left side of the centered vertical axis of the waist belt load portion, and a second curved slot on a right side of the centered vertical axis and wherein the waist belt is coupled to the waist belt load portion with a first pin mated to the first curved slot, with a second pin mated to the second curved slot, and with a third pin mated to the hole on the centered vertical axis of the waist belt load portion, wherein the waist belt load portion of the back plate is configured to rotate about an axis defined by the hole with respect to the waist belt and wherein the first pin slides in the first curved slot and the second pin slides in the second curved slot to enable rotation of the waist belt load portion with respect to the waist belt.

7. The self-contained breathing apparatus of claim 5, wherein the back plate is comprised of thermoplastic.

8. The self-contained breathing apparatus of claim 7, wherein the back plate is comprised of acrylonitrile butadiene styrene (ABS).

9. The self-contained breathing apparatus of claim 8, wherein the back plate is further comprised of nylon.

10. The self-contained breathing apparatus of claim 5, wherein the waist belt load portion is inset within the shoulder strap load portion.

11. A self-contained breathing apparatus back plate, comprising:

a shoulder strap load portion with a longitudinal centerline; and a waist belt load portion pivotally coupled to the shoulder strap load portion with a hinge attached to the shoulder strap load portion, wherein the waist belt load portion has an upper end connected to the hinge and a lower end distal the hinge, wherein the waist belt load portion is configured to fit substantially entirely within an aperture in the shoulder strap load portion, wherein the waist belt load portion is configured to rotate about an axis of rotation of the hinge oriented perpendicular to the longitudinal centerline of the shoulder strap load portion.

12. The self-contained breathing apparatus back plate of claim 11, wherein the hinge comprises a spring that biases the waist belt load back plate portion to align with the shoulder strap load back plate portion.

13. The self-contained breathing apparatus back plate of claim 11, wherein the hinge comprises stops to limit the range of rotation of the waist belt load back plate portion with respect to the shoulder strap load back plate portion.

14. The self-contained breathing apparatus back plate of claim 13, wherein the hinge stops prevent rotation of the waist belt load back plate portion beyond alignment with the shoulder strap load back plate portion in a first sense of rotation.

15. The self-contained breathing apparatus back plate of claim 14, wherein the hinge stops prevent rotation of the waist belt load back plate portion at less than 45 degrees out of alignment with the shoulder strap load back plate portion in a second sense of rotation.

16. The self-contained breathing apparatus back plate of claim 11, wherein a lower end of the back plate is shaped to curve away from a user's back when wearing the apparatus.

* * * * *